US008733839B2

(12) United States Patent
Bock

(10) Patent No.: US 8,733,839 B2
(45) Date of Patent: May 27, 2014

(54) MECHANISM FOR AN OFFICE CHAIR

(75) Inventor: Hermann Bock, Postbauer-Heng (DE)

(73) Assignee: Bock 1 GmbH & Co. KG, Postbauer-Heng (DE)

( * ) Notice: Subject to any disclaimer, the term of this patent is extended or adjusted under 35 U.S.C. 154(b) by 606 days.

(21) Appl. No.: 12/918,888

(22) PCT Filed: Jan. 21, 2009

(86) PCT No.: PCT/EP2009/000336

§ 371 (c)(1),
(2), (4) Date: Sep. 17, 2010

(87) PCT Pub. No.: WO2009/103389

PCT Pub. Date: Aug. 27, 2009

(65) Prior Publication Data

US 2011/0012409 A1 Jan. 20, 2011

(30) Foreign Application Priority Data

Feb. 22, 2008 (DE) ..... 10 2008 010 673
Jun. 11, 2008 (DE) ..... 10 2008 027 859
Sep. 3, 2008 (DE) ..... 10 2008 045 489

(51) Int. Cl.
*A47C 1/024* (2006.01)

(52) U.S. Cl.
USPC ..... 297/301.1

(58) Field of Classification Search
USPC ..... 297/301.1, 300.1, 303.1, 300.4
See application file for complete search history.

(56) References Cited

U.S. PATENT DOCUMENTS

| | | | | |
|---|---|---|---|---|
| 4,494,795 | A * | 1/1985 | Roossien et al. | 297/362.14 |
| 5,348,372 | A | 9/1994 | Takamatsu et al. | |
| 6,015,187 | A * | 1/2000 | Roslund et al. | 297/300.4 |
| 6,582,019 | B2 * | 6/2003 | Zwick et al. | 297/300.4 |
| 8,146,990 | B2 * | 4/2012 | Bock | 297/300.4 |
| 2003/0001417 | A1 | 1/2003 | Moreschi | |
| 2008/0272638 | A1 | 11/2008 | Bock | |
| 2009/0267394 | A1 | 10/2009 | Bock | |

FOREIGN PATENT DOCUMENTS

| | | | |
|---|---|---|---|
| DE | 4235691 | A1 | 6/1993 |
| DE | 4341071 | A1 | 6/1995 |
| DE | 102005020237 | B3 | 8/2006 |
| DE | 102007022015 | A1 | 4/2008 |
| EP | 1175854 | A1 | 1/2002 |
| EP | 1228722 | A1 | 8/2002 |
| JP | 231530 | U | 2/1990 |
| JP | 493637 | U | 8/1992 |
| JP | 05184432 | A | 7/1993 |
| JP | 07289383 | A | 11/1995 |

* cited by examiner

*Primary Examiner* — David R Dunn
(74) *Attorney, Agent, or Firm* — Laurence A. Greenberg; Werner H. Stemer; Ralph E. Locher

(57) ABSTRACT

A mechanism for an office chair has a displaceable actuating element. The position of the element changes during a movement of the office chair mechanism, and the change in position thereof changes the movement characteristic of the office chair mechanism. The actuating element is operationally connected to a functional element. The position of the functional element changes in the event of a change in the position of the actuating element during a movement of the office chair mechanism. At least one property of the change in position of the actuating element changes in the event of a change in the position of the functional element.

20 Claims, 15 Drawing Sheets

MECHANISM FOR AN OFFICE CHAIR

BACKGROUND OF THE INVENTION

Field of the Invention

The invention relates to a mechanism for an office chair having a displaceable actuating element, the position of said element changing during a movement of the office chair mechanism, and the change in position thereof changing the movement characteristic of the office chair mechanism.

Furthermore, the invention relates to a device for use in such an office chair mechanism and a method for varying the movement characteristic of an office chair mechanism having a displaceable actuating element, the position of said element changing during a movement of the office chair mechanism and the change in position thereof changing the movement characteristic of the office chair mechanism.

Numerous techniques for changing the movement characteristic of an office chair mechanism are familiar from the prior art. This takes the form of a pivoting movement as a rule. Depending on the mechanism used, it can take the form of a combined synchronous or asynchronous seat/backrest movement, for example. Other movements that can be achieved through an office chair mechanism include, for example, the adjustment of the inclination of the seat independently of the inclination of the backrest or the adjustment of the inclination of the backrest independently of the inclination of the seat.

If, for example, the resistance to pivoting of the backrest of an office chair is to be changed, it is customary to select a setting between "hard" and "soft" with the help of an actuating element, for example a handle or a crank, depending on whether the user of the office chair is a heavy or a light person.

A disadvantage associated with the solutions that are familiar from the prior art is that changing the movement characteristic of the office chair mechanism, in particular the resistance to pivoting of the backrest, for example, is often associated with a comparatively large effort.

BRIEF SUMMARY OF THE INVENTION

One object of the present invention is accordingly to make available a technique, with the help of which particularly easy changing of the movement characteristic of an office chair mechanism, in particular the resistance to pivoting of the backrest, for example, is possible.

This object is achieved by a mechanism as claimed or by a device as claimed or a method as claimed.

It is thus proposed to configure the mechanism in such a way that the actuating element is operationally connected to a functional element, the position thereof changing in the event of a change in the position of the actuating element during a movement of the office chair mechanism, wherein at least one property of the change in position of the actuating element changes in the event of a change in the position of the functional element.

It is proposed, furthermore, to configure the method in such a way that, in the event of a change in the position of the actuating element during a movement of the office chair mechanism, the position of a functional element operationally connected to the actuating element also changes, wherein at least one property of the change in position of the actuating element changes in the event of a change in the position of the functional element.

In other words, a central idea of the invention is to provide the actuating element with a position-adjustable functional element, the change in position whereof depends on the change in position of the actuating element on the one hand, and which, at the same time, has an influence on the change in position of the actuating element on the other hand. A self-adjusting, dynamic system for changing the movement characteristic of an office chair mechanism, in particular for changing the resistance to pivoting of the backrest of an office chair, for example, is thus accomplished with the invention, which system differs from the systems that are familiar from the prior art in that the adjustment of the movement characteristic, in particular the resistance to pivoting, for example, does not take place in an arbitrary fashion by the hand of the user, but always automatically and in accordance with the design features of the mechanism. An associated advantage is that particularly easy changing of the movement characteristic, in particular the resistance to pivoting, for example, is possible.

The invention is applicable to numerous office chair mechanisms, regardless of whether the mechanism is synchronous, asynchronous or of some other form.

Advantageous embodiments of the invention are indicated in the dependent claims.

The invention is particularly adaptable to a spring mechanism exhibiting at least one spring element, which mechanism is operationally connected to a backrest support of the office chair and determines the resistance to pivoting of the backrest support in the event of its pivoting from an initial position. The spring mechanism in this case exhibits the actuating element, the position thereof changing in the event of the pivoting of the backrest support, and the change in the position thereof changing the tension of the at least one spring element, the actuating element being operationally connected to the functional element, the position thereof changing in the event of a change in the position of the actuating element during pivoting of the backrest support. A particularly simple change to the resistance to pivoting of the backrest of an office chair is possible in this way.

It is particularly advantageous, furthermore, if the method for changing the movement characteristic of the office chair is adjustable by the user. According to a preferred embodiment of the invention, provision is made for this purpose for at least one property of the change in position of the functional element to be adjustable with the help of an adjustment device.

In the case of the adjustable property of the change in position of the functional element, this preferably concerns the nature and/or the possible scope, that is to say the extent of the change in position. For example the method of moving the functional element, including the movement pattern, such as rotation or translation, or the form of the movement curve, can thus be adjusted. The possible scope of the change in position can be defined by setting a lower limit and/or an upper limit and indicates a range of movement within which the functional element is able to move. Advantageously in this case, not only the scope of the free play, that is to say the breadth of the range, but also the position of the range, are adjustable. The same applies to the change in position of the actuating element brought about by the change in position of the functional element.

The spring mechanism that is operationally connected to the backrest support of the office chair can be connected to the backrest support both directly or indirectly. In the case of an indirect connection, the spring mechanism is preferably connected to the backrest support by means of the seat support as a coupling element. The actual design execution is dependent on the construction of the office chair and the nature of the mechanism (synchronous mechanism, asynchronous mechanism).

According to the invention, the tension of the at least one spring element is changed by the change in position of the actuating element, for example by a translational movement or a rotational movement of the actuating element. Spring elements of all kinds can be used in the spring mechanism for the purposes of the present invention. Helical springs in the form of leg springs, helical compression springs or helical tension springs have been found to be particularly advantageous because of their simplicity and robustness. If a leg spring is used, the actuating element is preferably configured as an integral component part of the leg spring. A spring leg of the leg spring finds a particular application as an actuating element. If a helical compression spring is used, on the other hand, a lever arm preferably acting upon the helical spring via a coupling device serves as an actuating element. In the event of the use of a helical tension spring, the actuating element is preferably an integral component part of the spring, in particular a hook provided on the end or a suspension eye.

An embodiment of the invention, in which the functional element is a rolling element or a sliding element mounted in a position-adjustable fashion and acted upon directly by the actuating element, preferably in the form of a cylindrical pin, has been found to be particularly advantageous. In an embodiment of this kind, the dynamic and automatic positioning of the functional element can be achieved particularly simply by bringing influence to bear on the actuating element in conjunction with pivoting of the backrest support.

The bearing required for mounting the functional element is preferably embodied as a part of the functional element. The bearing itself is preferably a rolling contact bearing, in particular in the form of a ball bearing or needle roller bearing. Of course, other actuating elements and bearing devices, for example sliding bearings, can also be used.

Setting the property of the change in position of the functional element takes place with the help of an adjustment device, preferably comprising a supporting track and/or a guide track for the functional element and an adjusting element for changing at least one property of the supporting track and/or the guide track. The supporting track and/or the guide track, which can be formed by the supporting surface of a bearing block, for example, is preferably capable of being changed in respect of its inclination in this case. The position of the end point, as far as which the functional element can be moved in conjunction with pivoting of the backrest support, depends on this changeable property of the supporting track and/or the guide track.

It is particularly advantageous, furthermore, for the functional element and/or the adjustment device to be executed in such a way that the setting of the at least one property of the change in position of the functional element takes place without, for this purpose, having to work against the spring force of the at least one spring element. In other words, the adjustment takes place "effortlessly". Depending on the embodiment of the mechanism, it may also be necessary for the adjustment of the spring force to be carried out not entirely "effortlessly", in particular if it is possible by so doing to achieve a particularly simple structural design and, at the same time, only very small spring forces must be overcome.

With the help of the present invention, a change in the spring force can be achieved at low cost and with little effort. A change in the mechanism from a "soft" to a "hard" setting is possible, for example, with two or three turns of a hand wheel, in conjunction with which it is necessary to work either not at all or only to a very small degree against the force of the at least one spring element of the spring mechanism.

BRIEF DESCRIPTION OF THE SEVERAL VIEWS OF THE DRAWING

Illustrative embodiments of the invention are described below in more detail with reference to the drawings, in which.

DESCRIPTION OF THE INVENTION

Figure 1:
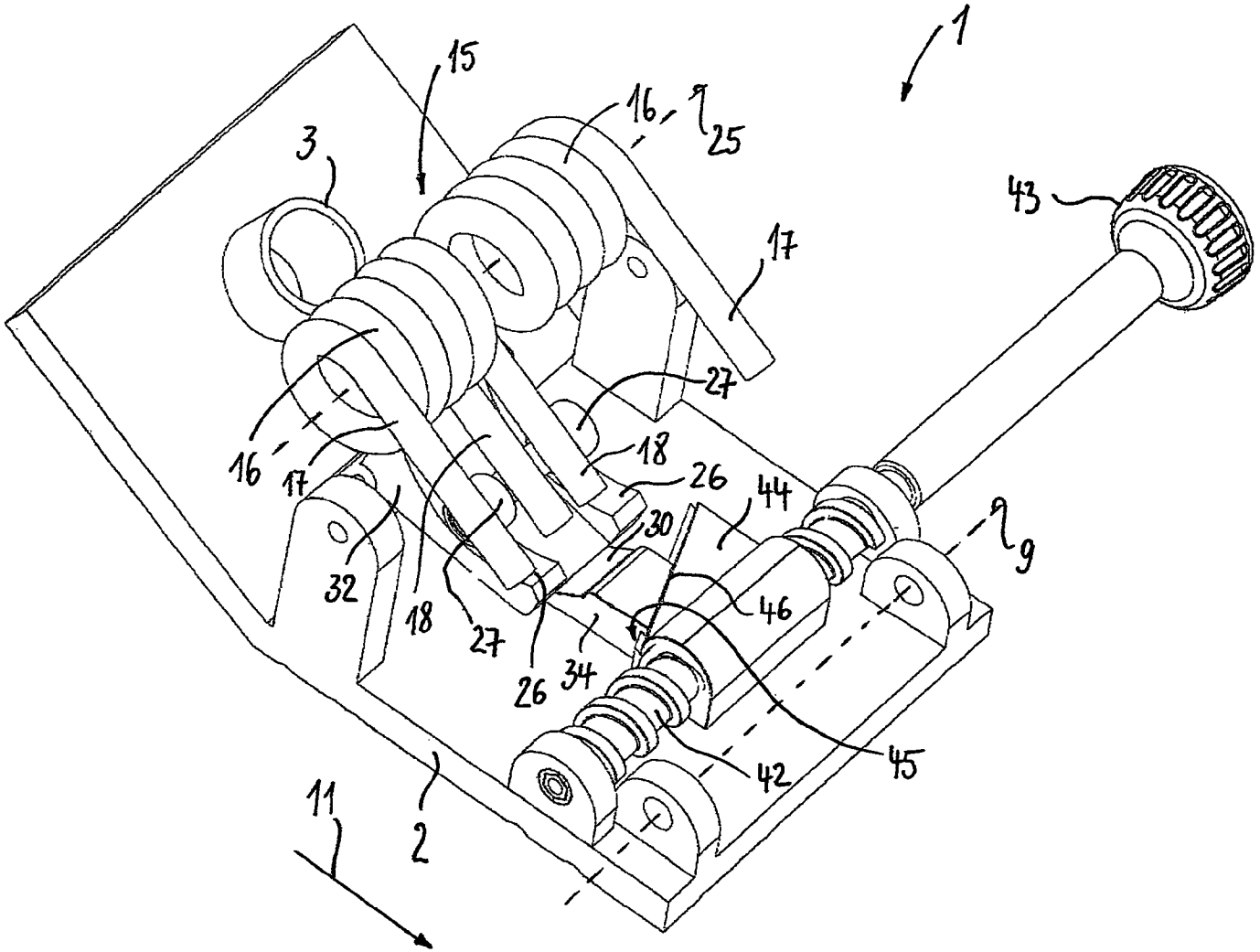
FIG. 1 depicts a perspective representation of a mechanism according to a first embodiment of the invention having a leg spring.

All the figures depict the invention only schematically and with its essential component parts. The same reference designations thus correspond to elements having the same or a comparable function.

A first illustrative embodiment of the invention is illustrated in FIGS. 1 to 5. The illustrations show parts of a pivoting mechanism 1 for an office chair, where only the constructive elements that are essential to an understanding of the present invention are depicted.

The pivoting mechanism 1 comprises a basic support 2 having a tapered holder 3 for the upper end of a chair column, a seat support 4 and a backrest support 5.

The front end 6 of the basic support 2 is connected in this case to the front end 7 of the essentially horizontally arranged seat support 4 via a pivotable hinge 8, by means of which the main pivot axis 9 of the mechanism 1 is constituted, which axis is oriented transversely to the longitudinal direction 11 of the chair. In addition, the rear end 12 of the seat support 4 is pivotally connected to the backrest support 5 at bearing points 13. Just as the seat support 4 can be provided with a seat, the backrest support 5 can also be provided with a backrest, neither the nature of the seat nor the nature of the backrest playing a significant role for the invention. The backrest support 5 is articulated additionally at its front end 14 on the basic support 2.

Figure 2:
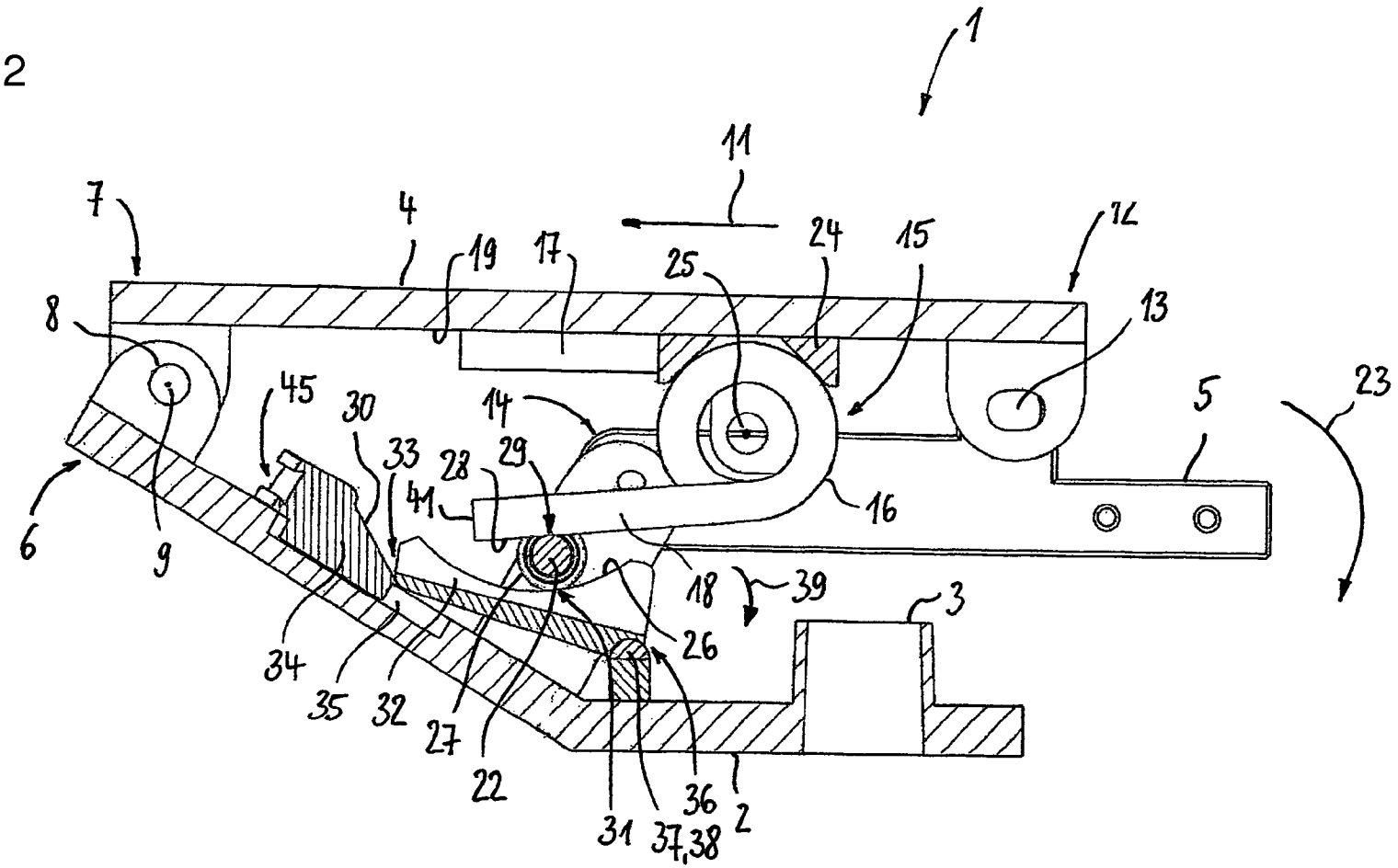
FIG. 2 depicts a sectional representation of the mechanism in FIG. 1 with a "soft" setting of the resistance to pivoting in an initial position.
Figure 3:
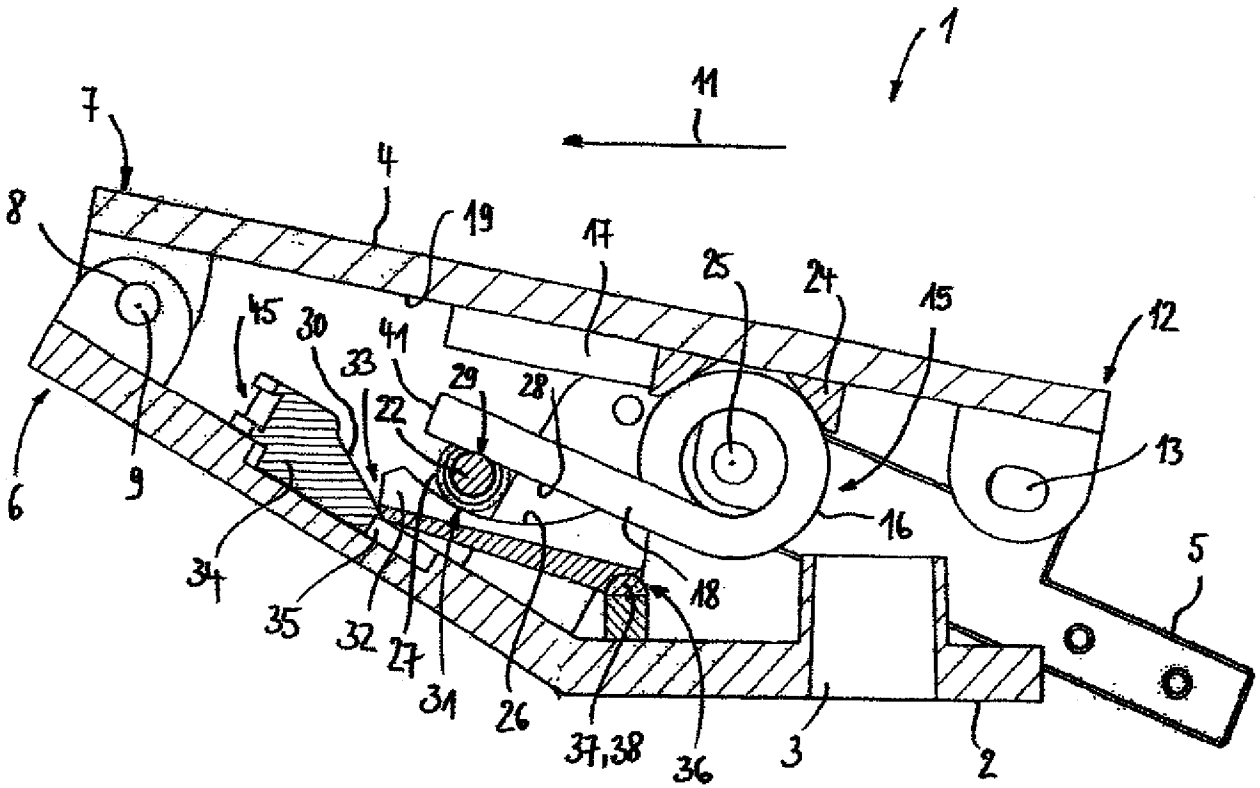
FIG. 3 depicts a sectional representation of the mechanism in FIG. 1 with a "soft" setting of the resistance to pivoting in a pivoted position.
Figure 4:
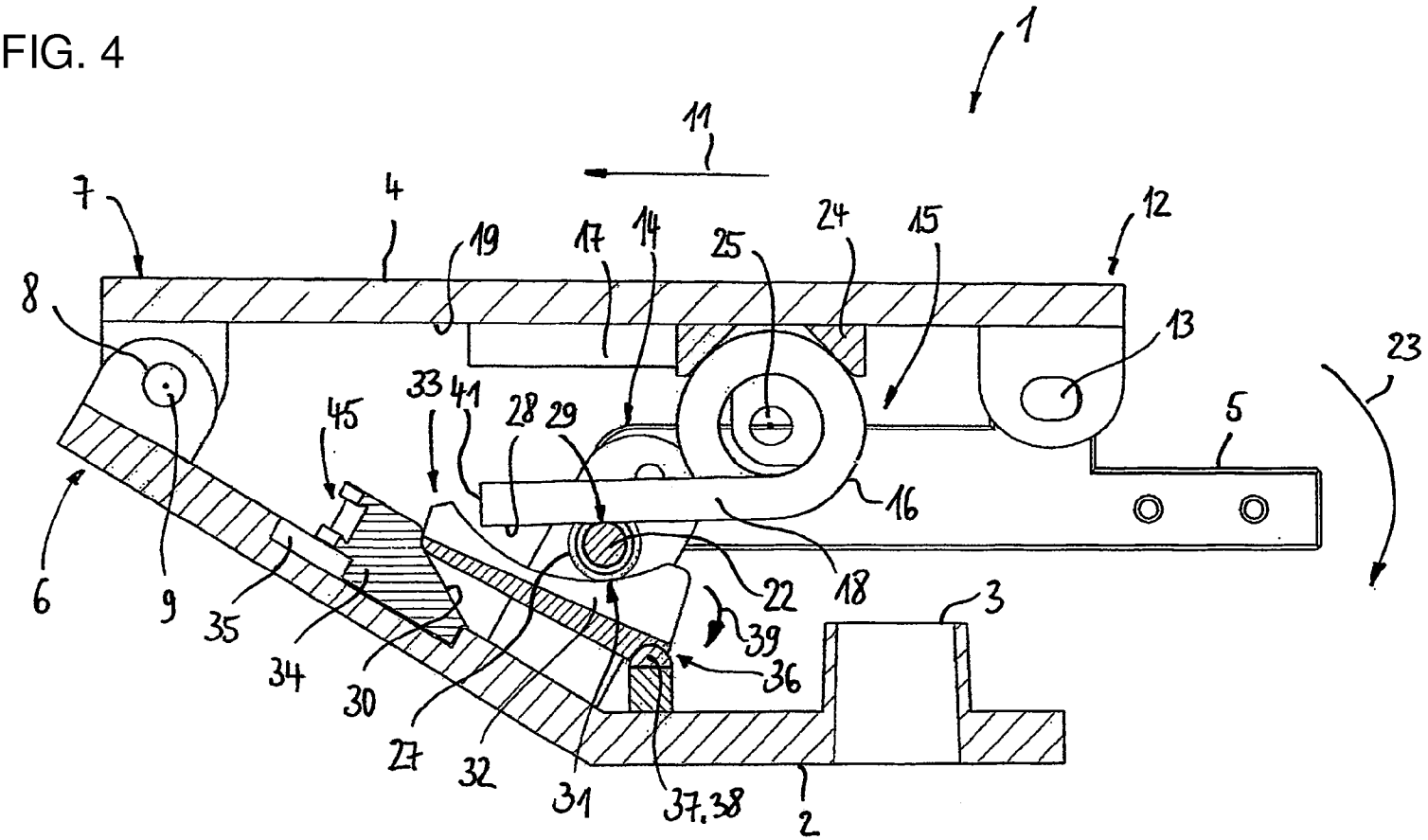
FIG. 4 depicts a sectional representation of the mechanism in FIG. 1 with a "hard" setting of the resistance to pivoting in an initial position.
Figure 5:
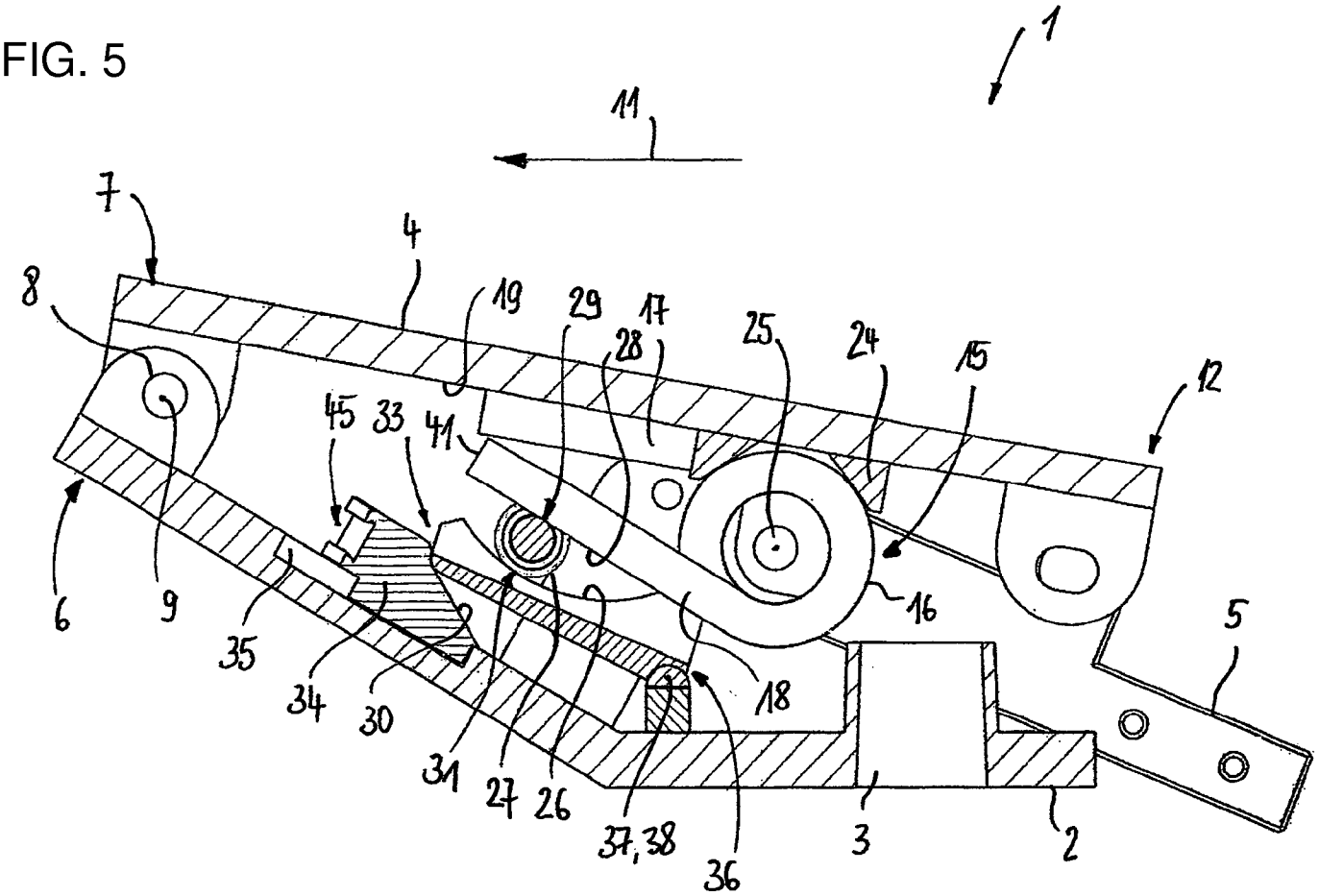
FIG. 5 depicts a sectional representation of the mechanism in FIG. 1 with a "hard" setting of the resistance to pivoting in a pivoted position.

The backrest support 5 is capable, when a user leans against the backrest, of being displaced from its initial position as depicted in FIGS. 2 and 4 into a pivoted position, for example as depicted in FIGS. 3 and 5. A spring mechanism 15, the mode of operation of which is explained in detail below, is provided for setting the return force of the backrest support 5.

The spring mechanism 15 comprises two leg springs 16, which are arranged in a largely unsupported manner between the basic support 2 and the seat support 4 and are supported in each case with their forward-facing upper and lower spring legs 17, 18 on the underside 19 of the seat support 4 and respectively on a movably arranged bearing pin 22. In the initial position, the spring legs 17, 18 in this case are oriented almost parallel to one another and to the seat support 4.

In the event of pivoting of the backrest support 5 in the direction of pivoting 23 in a direction downwards and rearwards, the seat support 4 that is connected to the backrest support 5 also pivots in the same manner, as a result whereof the two leg springs 16 are also caused to move together with the seat support 4, which springs are acted upon and are forced downwards by bearing prisms 24 arranged on the underside 19 of the seat support 4. The middle point of the spring defined by the position of the spring axis 25 is caused to move in this way.

In FIG. 2, the bearing pin 22 is present in the initial position between the lower spring legs 18 and the bearing surfaces 26 of a bearing block 32. The bearing surfaces 26 in this case are of concave execution. The bearing pin 22 exhibits at both its ends rolling contact bearings 27 in the form of ball bearings. The position of the rolling contact bearings 27 in this case corresponds to the position of the bearing surfaces 26 of the bearing block 32. The bearing block 32 preferably exhibits lateral guide flanks (not illustrated here), which serve for the lateral guidance of the bearing pin 22 on the bearing block 32 and, in so doing, ensure that the rolling contact bearings 27 for the bearing pin 22 make full contact with the bearing surfaces 26 at all times. The bearing pin 22 is thus held securely between the plane undersides 28 of the lower spring legs 18 on the one hand and the concave bearing surfaces 26 of the bearing block 32 on the other hand. The counter-bearings for the leg springs 16 executed on the lower spring legs 18 in this case form two first points of application 29 on the bearing pin 22, while two second points of application 31 on the bearing pin 22 are defined by its points of contact on the bearing surfaces 26 of the bearing block 32.

In the event of pivoting of the backrest support 5, the bearing pin 22 provided with the rolling contact bearings 27 is pushed forwards ("pantographical principle") by the movement of the lower spring leg 18 on the bearing surfaces 26 the of the bearing block 32. The bearing pin 22 and thus the points of application 29 of the bearing pin 22 on the undersides 28 of the lower spring legs 18 and the points of application 31 of the bearing pin 22 on the bearing surfaces 26 are forced to migrate in a forward direction. At the same time, the lower spring legs 18 in this case are pushed upwards by the bearing pin 22. The bearing pin 22 seeks to find a position for itself in a state of equilibrium. It remains in this end position; see FIG. 3. Since the track for the bearing pin 22 provided by the bearing surfaces 26 is comparatively flat, the position of the lower spring leg 18 in the pivoted position is also flat. The form and inclination of the bearing surfaces 26 is selected so that, in the event of the backrest support 5 being caused to pivot by the application of a loading to the backrest, i.e. in the event of tensioning the leg springs 16, the bearing pin 22 is not pushed forwards out of the bearing block 32.

In the initial state, the inclination of the bearing block 32 can now be changed with the help of an adjustment wedge 34. An adjustment wedge 34 is pushed under the front end 33 of the bearing block 32 for this purpose, said wedge being displaceably guided in a recess 35 in the basic support 2. The bearing block 32, which is connected at its rear end 36 to the basic support 2 at a rotating point 37, in this case slides on a functional surface 30 of the adjustment wedge 34 ascending in the direction of the front end of the chair and is tilted about a pivot axis 38 in the direction of pivoting 39 in such a way that the bearing surfaces 26 describe a steeper track in relation to the initial position; see FIG. 4.

From the front "soft" position of the adjustment wedge 34 in the initial position, the consequence thereof being the smallest possible resistance of the leg springs 16 against pivoting of the backrest support 5, see FIG. 2, a displacement of the adjustment wedge 34 takes place into a rear "hard" position, in which the leg springs 16 exhibit the greatest possible resistance to the pivoting of the backrest support 5, see FIG. 4.

In conjunction with the adjustment of the position of the bearing block, it is necessary to work against the spring force of the leg springs 16 only to a comparatively small degree. If the bearing block 32 were to be mounted centrally, as would be conceivable in another embodiment of the mechanism 1, the inclination of the bearing block 32 could thus be adjusted without having to work against the spring force of the leg springs 16. In the present example, however, this adjustment also takes place almost "effortlessly". In other words, the adjustment of the bearing surfaces 26 takes place almost without any change to the spring tension. The adjustment thus also takes place essentially irrespective of whether the person using the office chair is light or heavy.

The path of the bearing pin 22 in a forward direction is shortened by the resulting steeper track of the bearing surfaces 26 in conjunction with pivoting of the backrest support 5. The state of equilibrium occurs at an earlier stage. Compared with the pivoting position depicted in FIG. 3, the distance between the first application point 29 and the free end 41 of the lower spring leg 18 is greater; see FIG. 5. In other words, the bearing pin 22 can no longer move out of the way of the lower spring leg 18 to the same extent as was previously the case, since the now steeper track prevents it from doing so. As a result, the position of the lower spring leg 18 is comparatively steep. In other words, the angular movement of the lower spring leg 18 as far as the upper spring leg 17 is greater, the consequence whereof is an increased spring force and thus an increased resistance to pivoting.

The adjustment wedge 34 is moved in the longitudinal direction 11 of the chair with the help of an adjustment device, essentially comprising a threaded rod 42 having a hand wheel 43 mounted in the basic support 2, arranged on which rod is an axially displaceable wedge nut 44. The adjustment wedge 34 and the wedge nut 44 are connected to one another via a positive-engagement guide 45, which is executed in the form of a dovetail guide in the illustrative embodiment depicted here. The inclined position of the corresponding contact surfaces 46 of the adjustment wedge 34 and the wedge nut 44 lead to a deflection of the linear movement of the wedge nut 44 in the transverse direction through 90 degrees as far as a linear movement of the adjustment wedge 34 in the longitudinal direction 11 of the chair.

The manner in which the adjustment wedge 34 is caused to move can deviate from the embodiment depicted here. Other gear means and transmission means in particular are thus also applicable. The depicted spindle drive with its comparatively coarse thread is particularly advantageous, however, since not only is it very robust and accordingly less prone to faults, but at the same time fewer revolutions of the hand wheel 43 are also required in particular in order to produce a noticeable change in the resistance to pivoting.

In the event of pivoting of the backrest support 5, the distance from the first application point 29 to the spring axis 25 changes continuously, starting from an initial position of the bearing pin 22, until the bearing pin 22 has reached its end position as determined by the inclination of the bearing surfaces 26. In other words, the spring tension of the leg springs 16 changes with the pivoting and is changed by the pivoting of the backrest support 5. In order to ensure that a heavy person is aware of an increased basic resistance, the pre-tensioning of the leg springs 16 is increased, namely as a result of the rotating point 37 of the bearing block 32 being arranged eccentrically.

Actuation of the hand wheel 43 thus results in a change in the free play, within which a displacement of the bearing pin 22 is possible. Instead of this, in the case of solutions that are familiar from the prior art, only a structural element, which is provided in place of the bearing pin 22, is displaced in respect of its position and then secured. The position of this structural element does not change, however, in conjunction with pivoting. On the contrary, the bearing pin 22 in the present invention moves during and as a result of the movement of the backrest support 5. At the same time, the free play in the movement of the bearing pin 22, and thus the free play in the movement of the lower spring leg 18, is adjustable.

To put it another way, the free play, within which the lower spring legs 18 can move in order to change the tension of the leg springs 16, is defined by the change in the influencing parameters. The free play of the bearing pin 22 is increased in the case of a "light" setting, resulting in a comparatively small change in the position of the lower spring legs 18, whereas the free play of the bearing pin 22 is reduced in the case of a "heavy" setting. The spring mechanism 15 is permitted to change the position of the lower spring legs 18 to a greater extent in the case of a "heavy" setting.

Illustrated in FIGS. 6 to 10 is a further illustrative embodiment of the invention, in which a single spring mechanism having two helical compression springs 48 is used in place of two leg springs 16.

Figure 6:
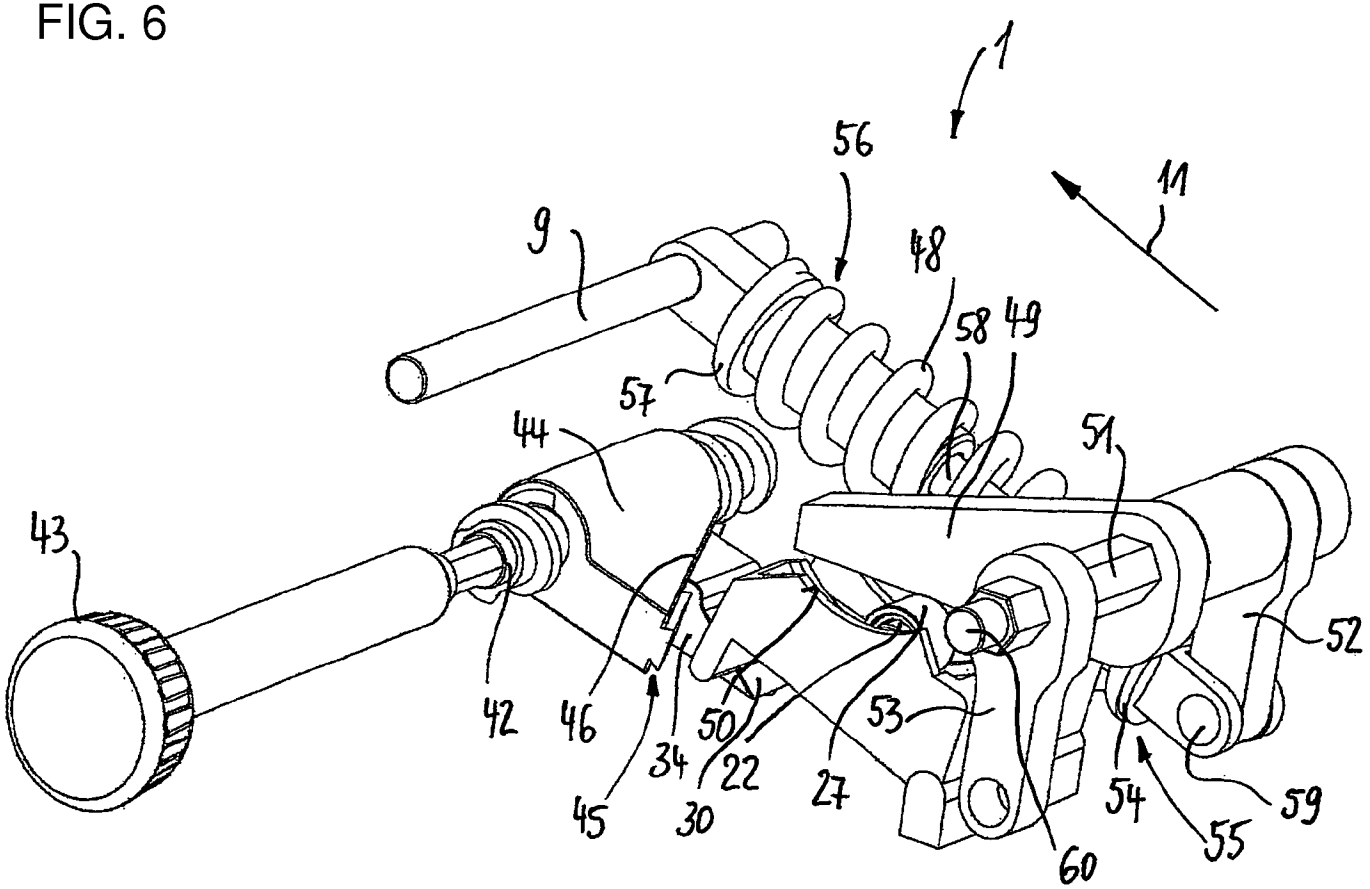
FIG. 6 depicts a perspective representation of a mechanism according to a second embodiment of the invention having a helical compression spring.
Figure 7:
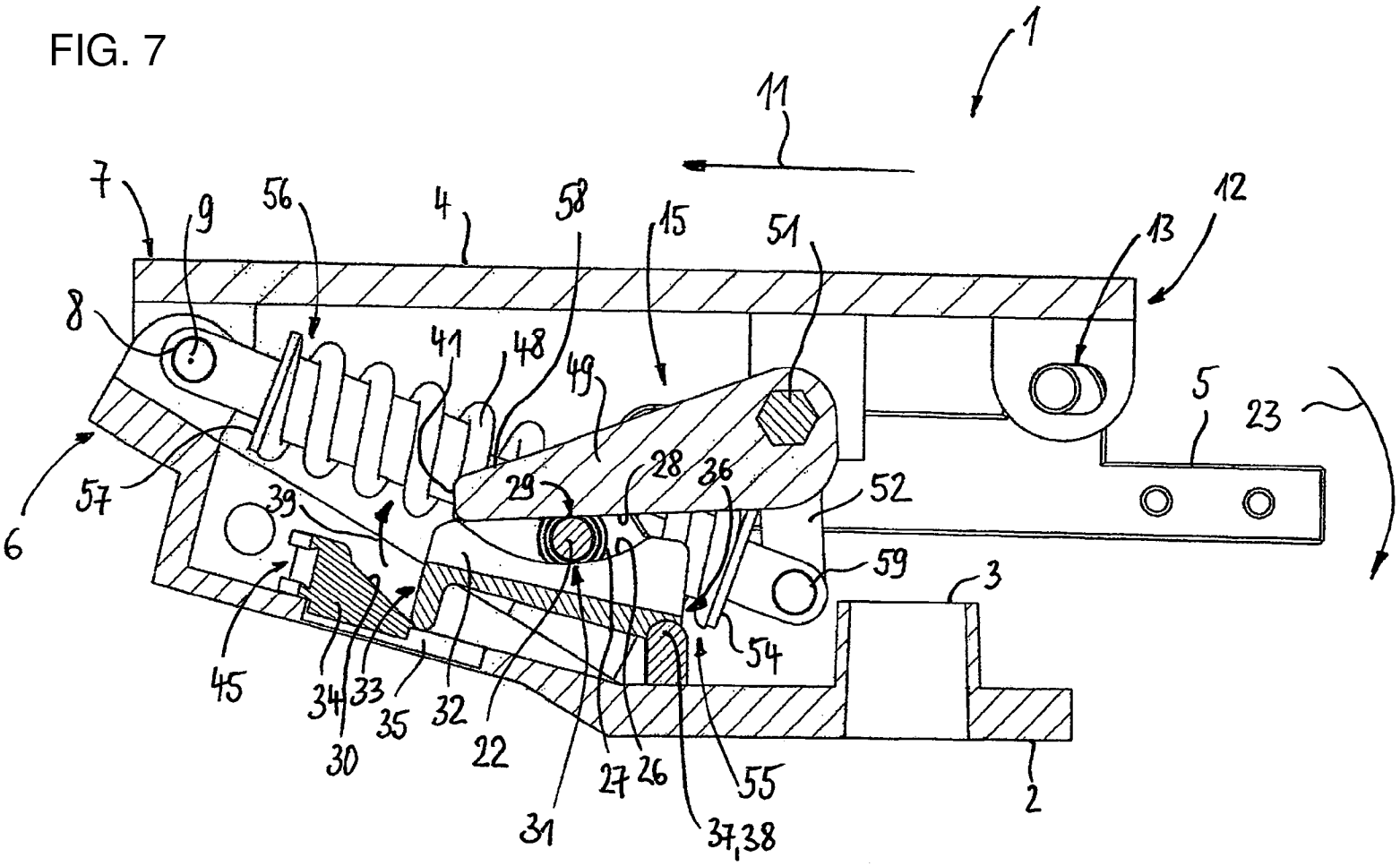
FIG. 7 depicts a sectional representation of the mechanism in FIG. 6 with a "soft" setting of the resistance to pivoting in an initial position.

Only the spring mechanism and the adjustment mechanism is depicted in FIG. 6. However, the arrangement of these structural elements corresponds largely to the arrangement depicted in FIGS. 1 to 5. Kinematically, the two illustrative embodiments correspond to one another to the greatest possible extent.

A component part of the spring mechanism in this case is a centrally arranged lever arm 49, which serves as an actuating element in the sense of the invention and is connected via an appropriate connecting element, here in the form of a hexagonal shaft 51, in a rotationally fixed manner to two retaining legs 52, 53. The lever arm 49 points forwards in the longitudinal direction 11 of the seat. Its underside 28 is oriented essentially horizontally in the initial position. In contrast to the previously described illustrative embodiment, in which two actuating elements in the form of the two lower spring legs 18 are used, the actuating element is not an integral component part of the spring elements, but acts via a coupling device on the springs of the spring mechanism, as described below.

One of the retaining legs 52 is connected via a pivotable hinge 59 to a spring seat 54, which defines the moving end 55 of the compression spring 48 and against which the compression spring 48 is supported. The opposing fixed end 56 of the compression spring 48 is articulated at the connection point 8 of the basic support 2 and the seat support 4 and is connected in this way to the main pivot axis 9 of the mechanism 1. A guide arrangement 61 configured as a hollow cylinder having a guide rod 58 guided therein is arranged in parallel inside the compression spring 48, which guide rod acts as a kink protection means to prevent the compression spring 48 from twisting as it is compressed. The guide arrangement 61 forms a spring seat 57 at the fixed end 56 of the compression spring 48. The guide rod 58 is connected to the spring seat 54 at the moving end 55 of the compression spring 48. However, the compression spring 48 does not necessarily have to be secured to the main pivot axis 9. Alternatively, the fixed end 56 alone can also be secured to the basic support 2 or the seat support 4.

The other retaining leg 53 is also connected—although this is not shown in FIG. 6 in the interests of clarity—via a pivotable hinge to the spring seat of a second compression spring, which, in its nature and arrangement, is of completely identical configuration to the compression spring 48 and, lying symmetrically on the other side of the lever arm 49, is also a component part of the spring mechanism 15. It is, of course, possible to use only a single spring element, both in this and in the previously described illustrative embodiment.

The hexagonal shaft 51 of the spring mechanism 15 is pivotally mounted on pivot points 60 on the seat support 4. In the event of pivoting the backrest support 5, which is also connected to the seat support 4 and is articulated to the basic support 2, from an initial position, see FIG. 6, into a pivoting position, see FIG. 7, in a direction of pivoting 23 downwards and rearwards, this movement is reproduced by the hexagonal shaft 51. The structural design is selected in such a way that the rear spring seats 54 that are attached to the retaining legs 52, 53 move forwards in this case in the longitudinal direction 11 of the chair because of the connection via the retaining legs 52, 53, as a result whereof the two compression springs 48 are tensioned. At the same time, the lever arm 49 presses on the bearing pin 22, causing it to move from its initial position into the end position as defined by the inclination of the bearing surfaces 26 because of the application of pressure by the lever arm 49. At the same time, the lever arm 49 lying on the bearing pin 22 is forced upwards ("pantographical principle") by the bearing pin 22.

In contrast to the first illustrative embodiment, the lateral guide flanks 50 of the bearing block 32, which serve for the lateral guidance of the bearing pin 22 on the bearing block 32, are illustrated in this case.

Figure 8:
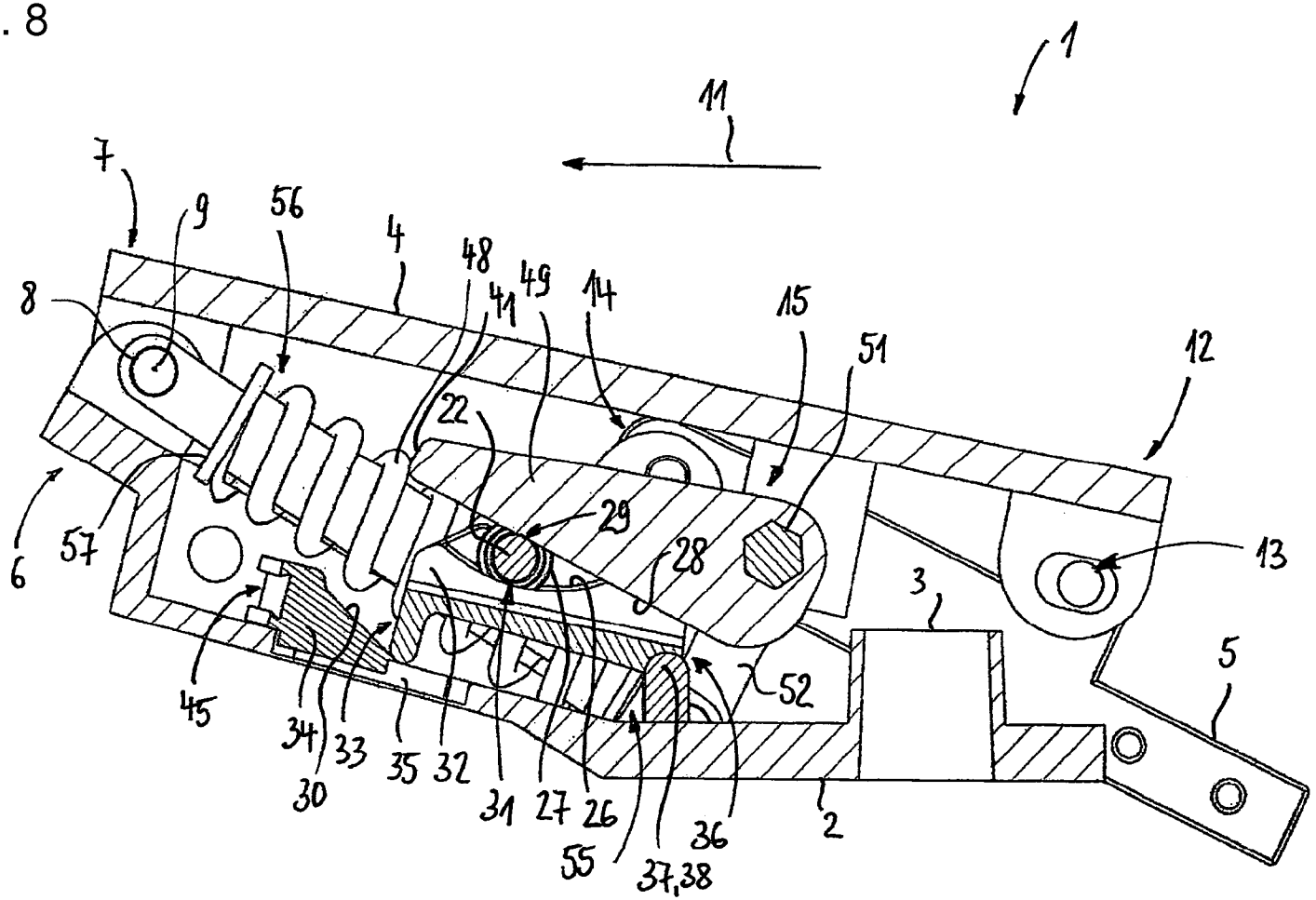
FIG. 8 depicts a sectional representation of the mechanism in FIG. 6 with a "soft" setting of the resistance to pivoting in a pivoted position.
Figure 9:
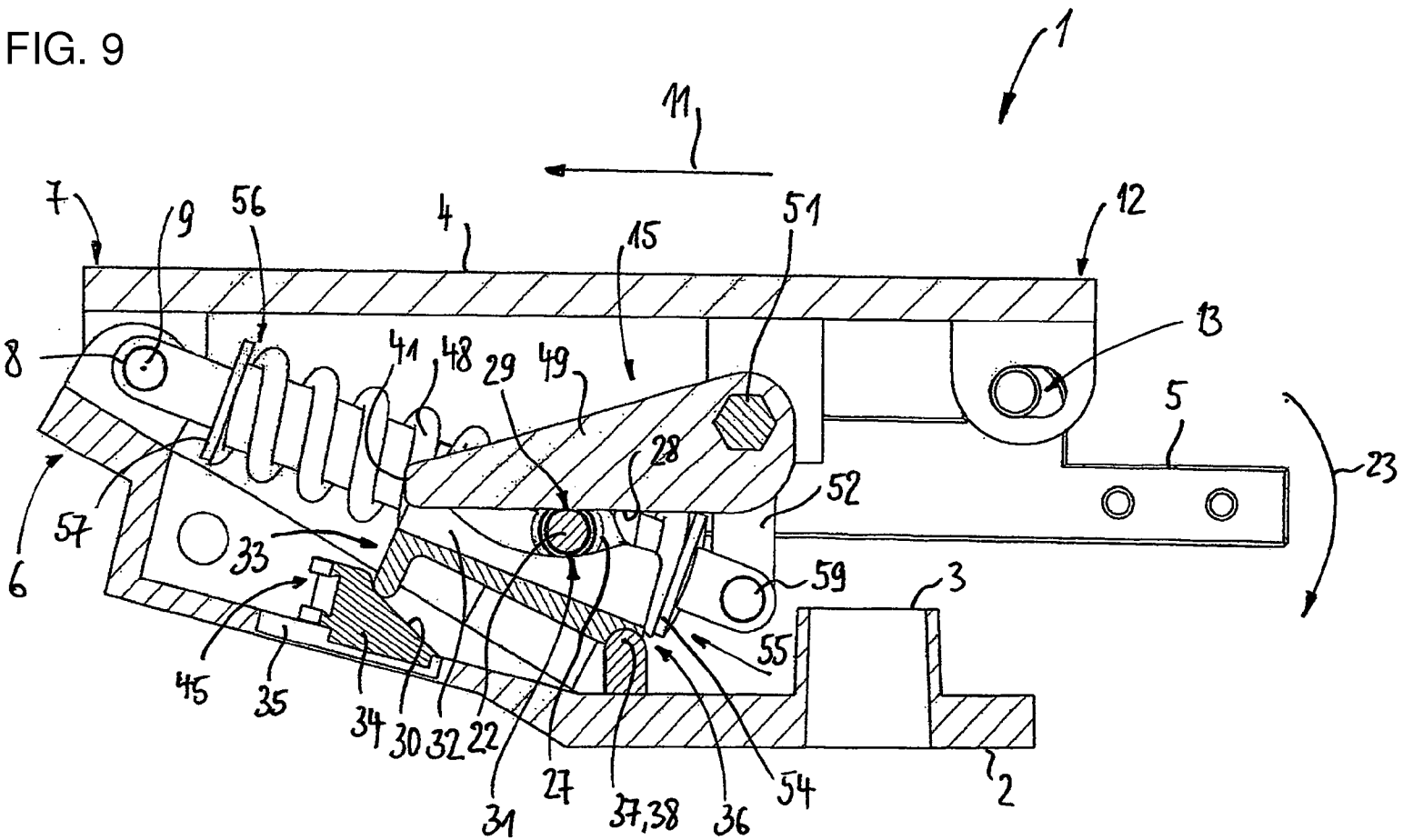
FIG. 9 depicts a sectional representation of the mechanism in FIG. 6 with a "hard" setting of the resistance to pivoting in an initial position.
Figure 10:
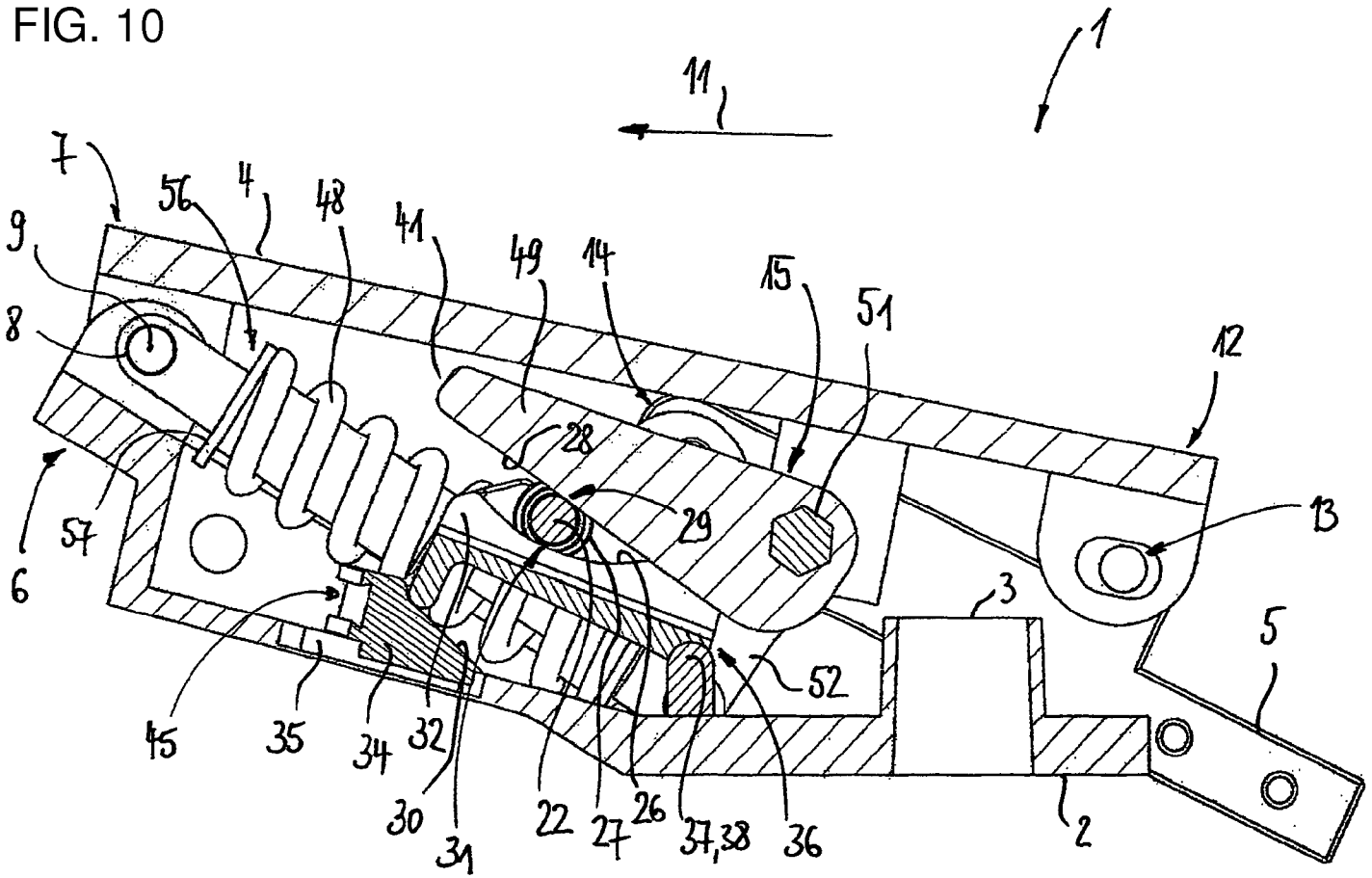
FIG. 10 depicts a sectional representation of the mechanism in FIG. 6 with a "hard" setting of the resistance to pivoting in a pivoted position.
Figure 11:
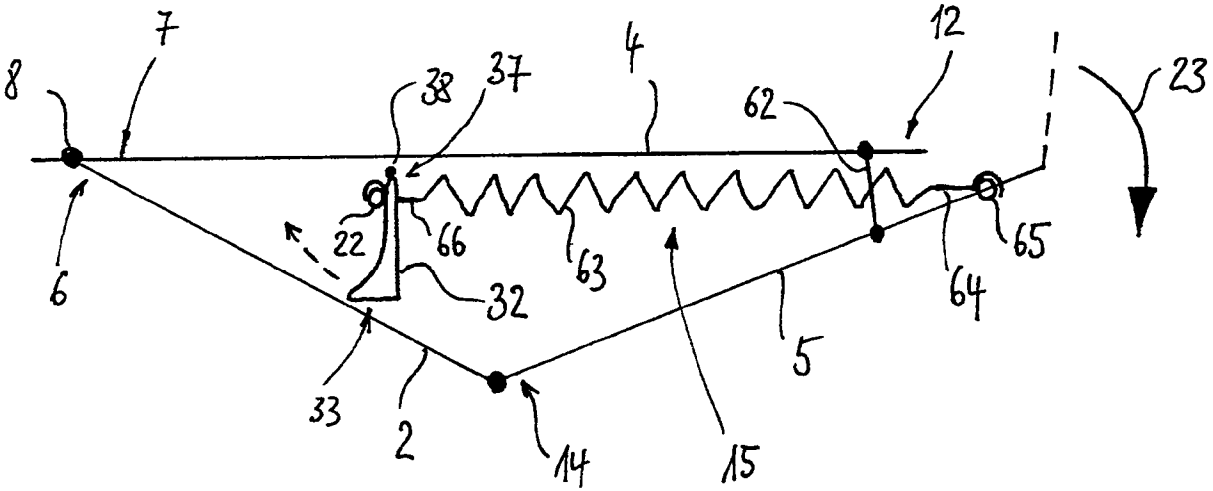
FIG. 11 depicts a perspective representation of a mechanism according to a third embodiment of the invention.

Following a change in the inclination of the bearing surfaces 26, see FIG. 8, the result is the same as that obtained in the previous illustrative embodiment. The bearing pin 22 comes to a standstill earlier because of the steeper track; see FIG. 9. The position of the lever arm 49 is then comparatively steep. This is reflected in an increase in the spring force of the compression spring 48 and thus in an increase in the resistance to pivoting.

A third illustrative embodiment of the invention is depicted in FIGS. 11 to 15. The drawings show parts of a pivoting mechanism 1 for an office chair. The actual backrest in this case is indicated with broken lines. The backrest support 5 is connected to the rear end 12 of the seat support 4 via a guide arrangement 62. The front end 14 of the backrest support is connected in an articulated fashion to the basic support 2, which is connected at its front end 6 to the front end 7 of the seat support via a pivotable hinge 8. A bearing block 32 is pivotally attached to the seat support 2, although the connection of the bearing block 32 and the seat support 2 is not depicted in FIG. 11. The pivot axis 38 of the bearing block passes through a pivot point at the rear (upper) end 37 of the bearing block 32. The nature of the adjustment of the bearing block 32 can vary and is not shown here in detail. Pivoting of the front bearing block 33 in a forward direction can take place, however, as a result of the adjustment, which leads to a "hard" setting of the mechanism, as described in more detail below.

A spring mechanism 15 for setting the adjustment force of the backrest having at least one spring element in the form of a helical tension spring 63 is proposed. It is assumed in the following, for example, that only a single helical tension spring 63 is used. Two or more springs can also be used, however. The helical tension spring 63 is attached with its rear spring end 64, which is configured as a suspension eye or an open hook, centrally to a transverse pin 65 running between the two arms of the backrest support 5, which pin can be regarded as a part of the backrest support 5. The spring 63 is thus connected directly to the backrest support 5 without any additional coupling element. The front end 66 of the spring, which is also configured as a suspension eye or an open hook, is connected to a bearing pin 22. The front end 66 of the spring in this case serves as an actuating element in the sense of the invention. As in the embodiments described above, the bearing pin exhibits at both of its ends rolling contact bearings 27 in the form of ball bearings and lies with these on the bearing surfaces 26 of the bearing block 32; see FIG. 16.

Figure 12:
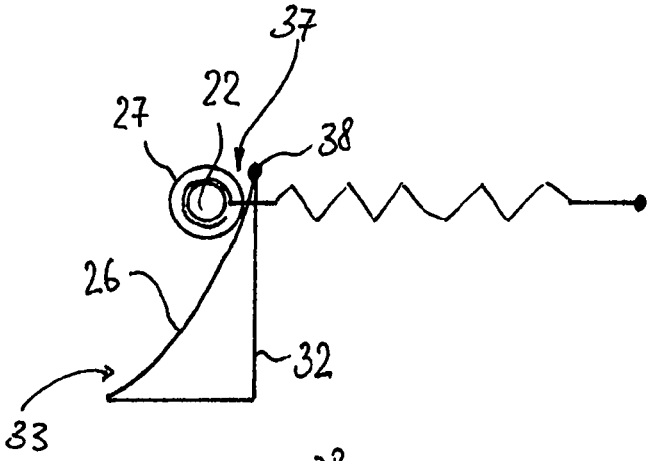
FIG. 12 depicts a detailed representation of the mechanism in FIG. 11 with a "soft" setting of the resistance to pivoting in an initial position.

In the initial position depicted in FIG. 12, which is characterized by an essentially horizontal position of the helical tension spring 63, the pin 22 is present on the bearing surface 26 in the vicinity of the rear (upper) end 37 of the bearing block. The act of pivoting the backrest support 5 rearwards and downwards in the direction of pivoting 23 causes the position of the front end 66 of the spring to change. This change in position is associated with an extension of the spring 66 and thus with a change in the resistance to pivoting; see FIG. 13. At the same time, the pin 22 is entrained by the end 66 of the spring, so that it moves forwards (downwards) on the bearing surface 26 in the direction of the front (lower) end 33 of the bearing block.

Figure 13:
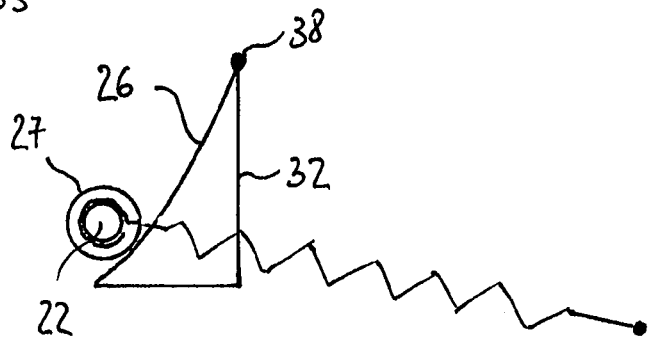
FIG. 13 depicts a detailed representation of the mechanism in FIG. 11 with a "soft" setting of the resistance to pivoting in a pivoted position.

With the bearing block 32 in the position depicted in FIGS. 12 and 13, the rolling curve defined by the concave bearing surface 26 is comparatively flat in relation to the vertical. Pivoting of the spring 63 can cause the pin 22 to deviate comparatively strongly, as a result whereof the spring 63 is extended only to a comparatively small extent. In this "soft" setting, it is thus comparatively easy for the user to cause the backrest of the office chair to pivot rearwards. The resistance to pivoting is low.

Figure 14:
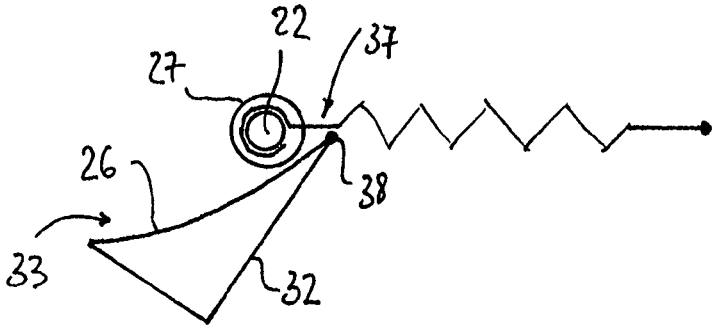
FIG. 14 depicts a detailed representation of the mechanism in FIG. 11 with a "hard" setting of the resistance to pivoting in an initial position.
Figure 15:
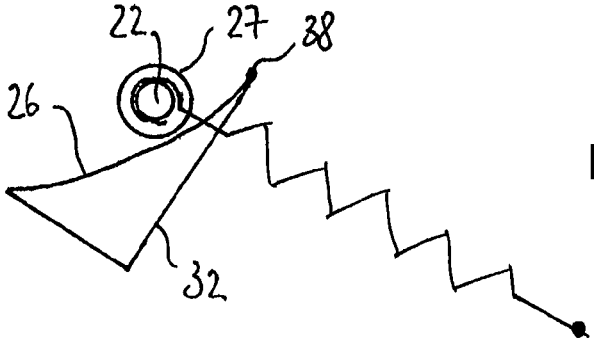
FIG. 15 depicts a detailed representation of the mechanism in FIG. 11 with a "hard" setting of the resistance to pivoting in a pivoted position.

If the position of the bearing block 32 is now changed in such a way that the rolling curve defined by the bearing surface 26 becomes comparatively steep in relation to the vertical, see FIGS. 14 and 15, the pivoting of the backrest support 5 causes a comparatively weak (short) deviation of the pin 22, as a result whereof the spring 63 is extended more strongly than previously. In this "hard" setting, it is thus more difficult for the user to cause the backrest of the office chair to pivot rearwards. The resistance to pivoting is high. The angle of pivoting of the backrest support 5 remains the same here, as in the previously described illustrative embodiments, and this regardless of the position of the bearing block 32. The mechanism is designed in such a way that the actuating element always describes the same movement.

Figure 16:
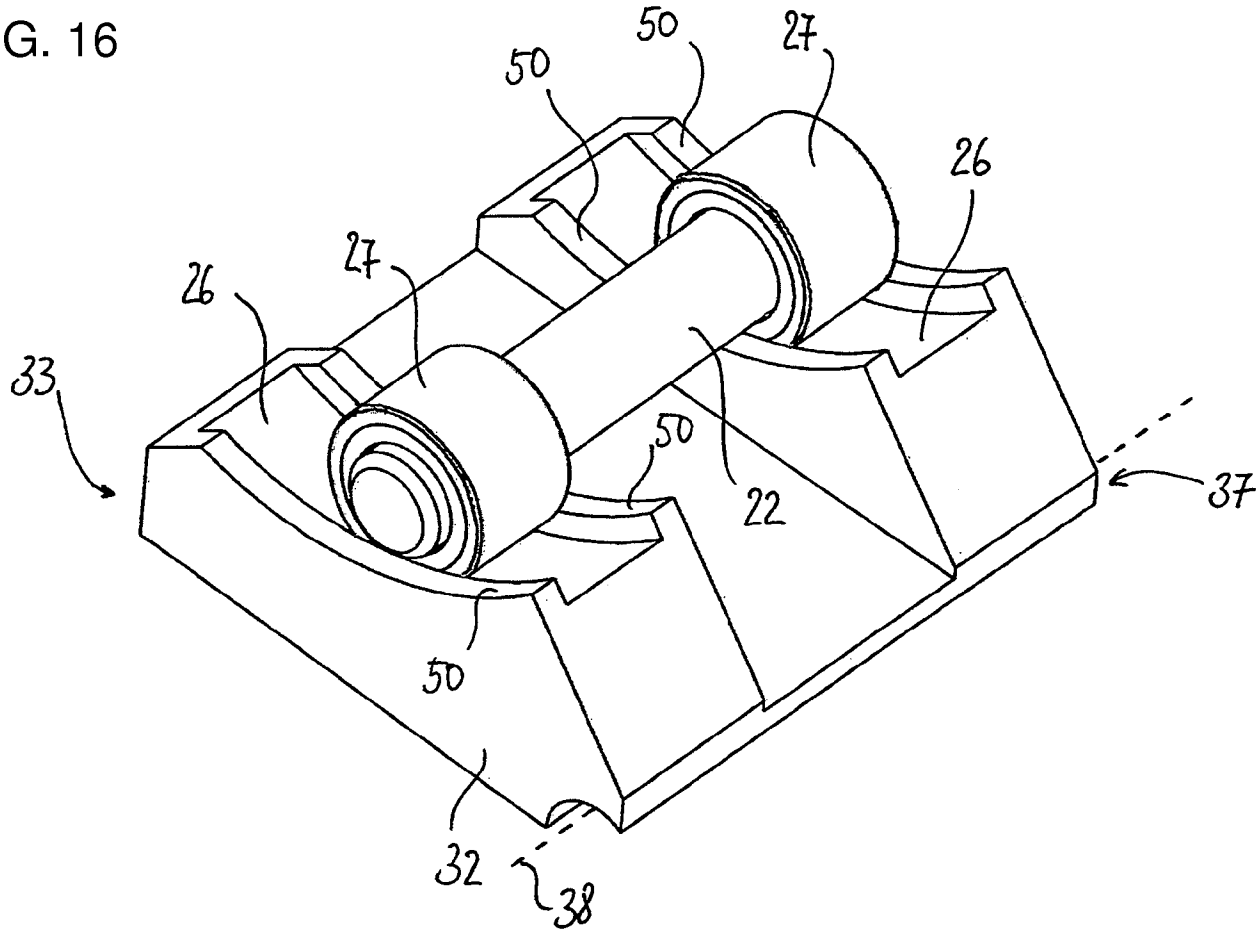
FIG. 16 depicts a perspective representation of bearing pins and bearing blocks as component parts of all three depicted embodiments of the invention.

The device intended for use in the office chair mechanism 1 is illustrated in detail in FIG. 16. It comprises the positional-adjustable functional element 22 in the form of a rolling and/or sliding body having two bearings 27 for the rotational bearing of the functional element 22 and a supporting track and/or a guide track for the bearings 27 formed by two concave bearing surfaces 26 of the bearing block 32.

Figure 17:
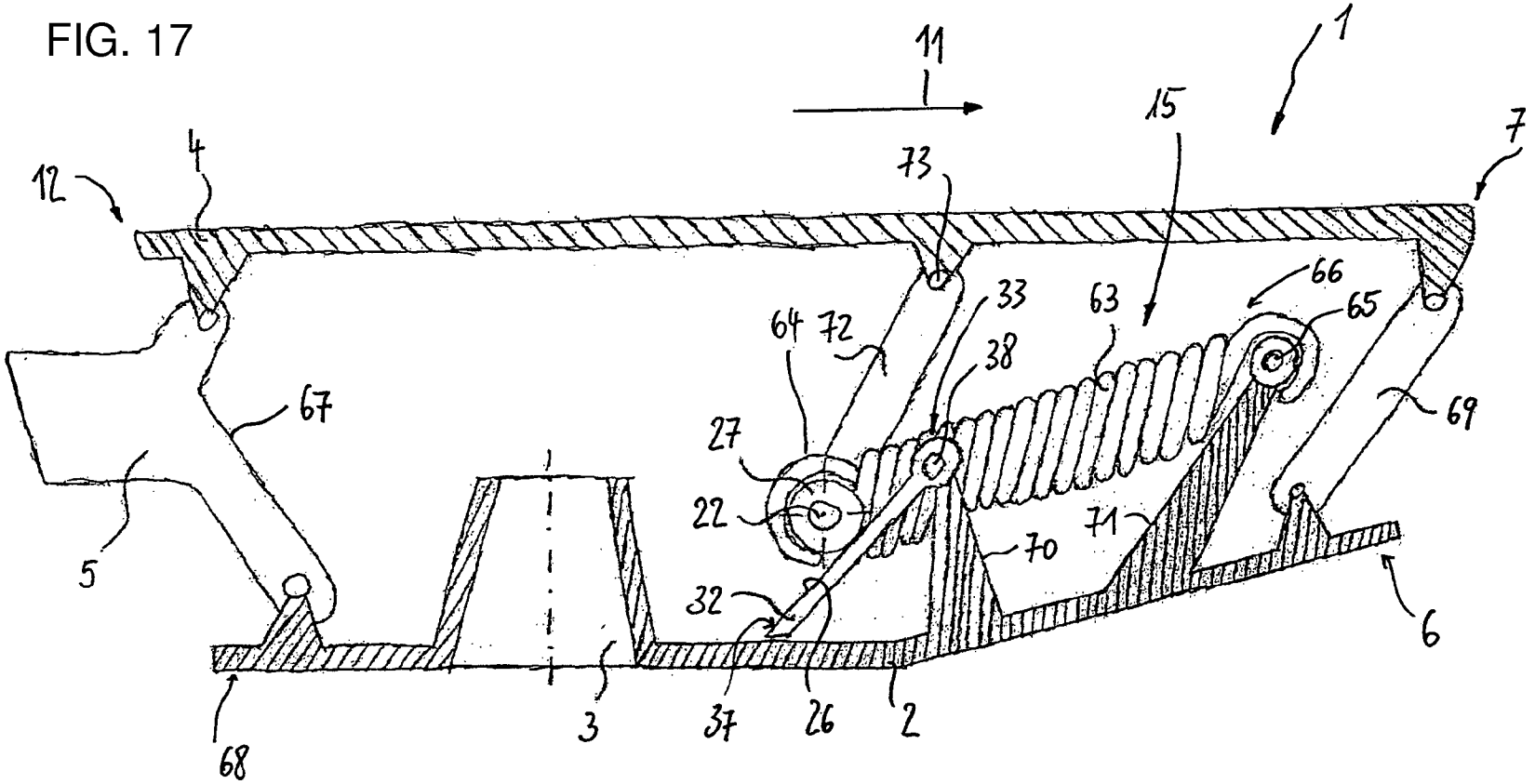
FIG. 17 depicts a sectional representation of a mechanism according to a fourth embodiment of the invention in an initial position.
Figure 18:
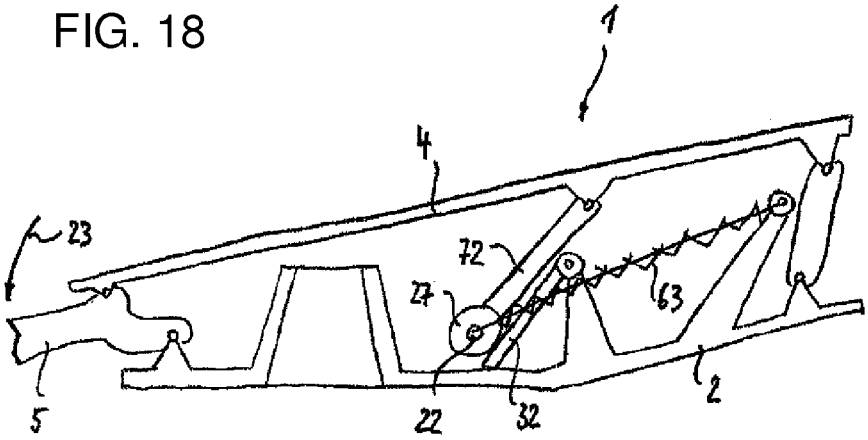
FIG. 18 depicts a sectional representation of the mechanism in FIG. 17 with a "soft" setting of the resistance to pivoting in a pivoted position.
Figure 19:
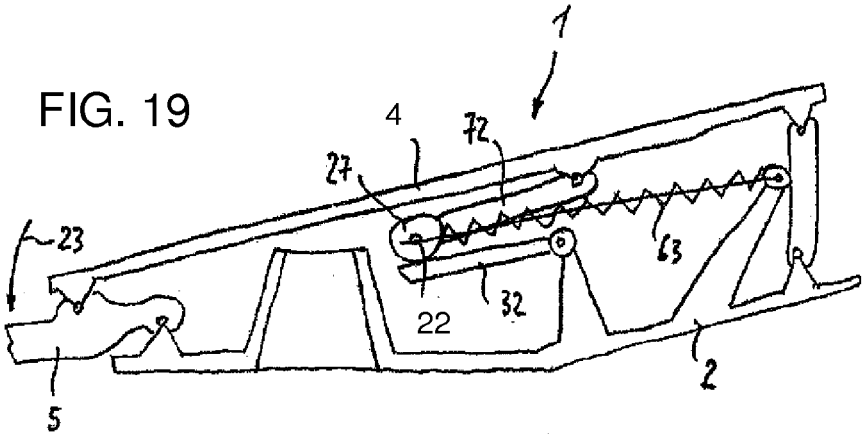
FIG. 19 depicts a sectional representation of the mechanism in FIG. 17 with a "hard" setting of the resistance to pivoting in a pivoted position.

A fourth illustrative embodiment of the invention is illustrated in FIGS. 17 to 19. The drawings depict parts of a pivoting mechanism 1 for an office chair. The backrest support 5 is pivotally connected via a common guide arrangement 67 both to the rear end 12 of the seat support 4 and to the rear end 68 of the basic support 2. The basic support 2 is pivotally connected at its front end 6 to the front end 7 of the seat support via a second guide arrangement 69.

A bearing block 32 is pivotally attached to a structural element 70 of the seat support 2. The pivot axis 38 of the bearing block 32 passes through a rotating point on the front (upper) end 33 of the bearing block 32. The inclination of the—in this case plane—bearing surface 26 of the bearing block 32 is variable with the help of an adjusting element (not illustrated). Pivoting of the rear end 37 of the bearing block upwards in the direction of the seat support 4 can be effected in this way, which leads to a "hard" setting of the mechanism, as described in more detail below. Instead of being plane, however, the bearing surface 26 can also be of concave or convex execution, as in the case of the previously described illustrative embodiments.

A spring mechanism 15 for setting the adjustment force of the backrest having at least one spring element in the form of a helical tension spring 63 is proposed. It is assumed in the following, for example, that only a single helical tension spring 63 is used. Two or more springs lying parallel in relation to one another can also be used, however. The helical tension spring 63 is attached by the front end 66 of the spring, which is configured as a suspension eye or an open hook, to a transverse pin 65 running between structural elements 71 of the basic support 2. The rear end 64 of the spring, which is also configured as a suspension eye or an open hook, is connected to a bearing pin 22. The rear end 64 of the pin in this case serves as an actuating element in the sense of the invention. As in the embodiments described above, the bearing pin 22 exhibits at both of its ends rolling contact bearings 27 in the form of ball bearings and lies with these on the bearing surfaces 26 of the bearing block 32.

The bearing pin 22 is pivotally connected to a coupling element 72. The bearing pin 22 is supported at one end of the coupling element 72 for this purpose. The opposing end of the coupling element 72 is pivotally connected to the seat support 4 at a pivot point 73. The act of pivoting the backrest support 5 in the direction of pivoting 23 downwards and rearwards also causes the seat support 4 attached to the backrest support 5 to pivot in the same manner. This brings about a displacement of the pivot point 73 of the coupling element 72 on the seat support 4, as a result of which the position of the bearing pin 22 and thus the position of the helical tension spring 63 is also changed via the coupling element 72. The seat support 4 thus serves together with the coupling element 72 for the indirect connection of the spring mechanism 15 to the backrest support 5.

The inclination of the bearing surface 26 is set in the initial position, that is to say with the backrest not pivoted. In the optimal "soft" setting, the rear end 37 of the bearing block 32 bears against the basic support 2. The angle of the bearing surface 26 to the horizontal is approximately 60°; see FIG. 18. In the "hardest" setting, the bearing surface 26 lies almost horizontally. The angle of the plane bearing surface 26 to the horizontal in this case is approximately 10°; see FIG. 19. Because the bearing pin 22 in the initial position is situated close to the rotating point and the bearing point 38 of the bearing block 26, see FIG. 17, the adjustment of the inclination, and thus the adjustment of the setting of the spring force, takes place almost effortlessly. The spring 63 is only minimally pre-tensioned in this case.

In the initial position depicted in FIG. 17, the pin 22 is situated approximately in the middle of the bearing surface 26. The act of pivoting the backrest support 5 rearwards and downwards in the direction of pivoting 23 causes the position of the rear end 64 of the spring to change. This change in position is associated with an extension of the spring 63 and thus with a change in the resistance to pivoting. At the same time, the pin 22 is entrained by the coupling element 72, so that it is displaced on the bearing surface 26 rearwards in the direction of the rear end 37 of the bearing block.

In the pivoting position depicted in FIG. 18, the rolling curve defined by the bearing surface 26 is comparatively flat in relation to the vertical. Pivoting of the spring 63 can cause the pin 22 to deviate comparatively strongly downwards, as a result whereof the spring 63 is extended only to a comparatively small extent. In this "soft" setting, it is thus comparatively easy for the user to cause the backrest of the office chair to pivot rearwards. The resistance to pivoting is low.

If the position of the bearing block 32 is now changed in such a way that the rolling curve defined by the bearing surface 26 becomes comparatively steep in relation to the vertical, see FIG. 19, the pivoting of the backrest support 5 causes a stronger displacement of the pin 22 in the direction of the backrest support 5 and an associated stronger extension of the spring 63. In this "hard" setting, it is thus more difficult for the user to cause the backrest of the office chair to pivot rearwards. The resistance to pivoting is high. The angle of pivoting of the backrest support 5 remains the same here, as in the previously described illustrative embodiments, and this regardless of the position of the bearing block 32.

The embodiment of the structural elements 70, 71 and the arrangement of the rotating points 38, 65 are also variable in the previously described illustrative embodiment for setting the desired pivoting characteristic, as are the form of the curved track 26 for the bearing pin 22 and the length and arrangement of the coupling element 72.

Individual aspects of the present invention are explained below in detail once again.

It is assumed initially that the pin 22 would not be provided with bearings 27, but that it would rest directly on a track.

If the track, on which the pin 22 moves, is not a curved track, but rather a plane surface, and if an actuating element rolling on this pin 22 were to move parallel to the track at all times, then no deviation forces would act on the pin 22. However, the actuating element in an office chair mechanism always describes an angular movement. A curved track, which, through its defined incline, excludes the possibility of an undesired pushing away of the pin 22 from the track, is proposed for this reason.

If the actuating element were now to bear against such an unsupported pin 22, this pin would initially always perform a rolling movement in the event of an angular movement of the actuating element. In the case of an excessively steep gradient of the curved track 26, however, the pin 22 would be impeded from rolling. The rolling movement of the pin 22 would be transformed into a sliding movement, resulting in undesired wear to the pin 22 and the track. Accordingly, it is proposed to provide the pin 22 with bearings 27, in which the pin 22 is freely rotatable and thus achieves an additional rotational degree of freedom. A transition to sliding friction in the case described above is effectively prevented in this way.

The movement of the functional element under the influence of the actuating element accordingly requires to be described once more with reference to the example described in FIGS. 2 and 3. If, in conjunction with pivoting of the backrest support 5, the actuating element in the form of the lower spring leg 18 of the leg spring 16 presses against the application point 29 on the functional element in the form of the pin 22, this is accompanied by an angular change in the spring leg 18. This change in the position of the spring leg 18 results in an imbalance in the forces, by which the position of the pin 22 on the track is changed. The pin 22 continues to deviate from the spring leg 18 that is inclined at an angle until a balance in the forces is restored by the curve geometry of the track. The latest point at which the pin 22 comes to a halt is when the spring leg 18 is parallel to the respective tangent passing through the contact point 31 of the pin 22 in relation to the track (bearing surface 26). The steeper the track, the sooner this balance in the forces is achieved and the less the pin 22 will deviate. The smaller the deviation of the pin 22, the steeper the gradient of the spring leg 18—for the same pivoting of the backrest support 5. The result of this is that the spring 16 is tensioned a more tightly. To put it another way: the spring force response of the mechanism 1 or some other property of the movement characteristic can be set by a change in the position, in particular by pivoting, of the bearing block 32 and an associated change in the curved path.

In principle, however, the bearing block 32 can also be permanently installed—depending on the particular application—i.e. if it is not required to be pivotable or tiltable. The adjustability of the at least one property of the change in position of the pin 22 would no longer apply in such a case, however. Even in this case, however, the wear on the mechanism 1 would be reduced because of the spring mechanism 15 that is tensioned in the absence of sliding friction.

The position of the bearing point of the bearing block 32, that is to say the position of the pivot axis 38, can vary. The more remote the bearing point from the axis of the pin 22, the greater the pre-tensioning that can be achieved in the event of adjustment of the spring mechanism 15. The closer the pivot axis 38 approaches to the position of the pin 22, the lower the pre-tensioning that can be achieved with the spring mechanism 15.

In the simplest case, the track can exhibit the form of a circular arc section. Variations (initially flat, and subsequently becoming steeper) are possible and as a consequence possess another dynamic spring behaviour. In this way, the mechanism can exhibit a degressive, linear or progressive behaviour, depending on the customer's requirements. In other words, it is possible to change the movement characteristic of the mechanism not only by the a setting of the inclination of the bearing block 32. This is also possible by changing the concavity of the bearing surface 26, that is to say the form of the curved track. The curved track in this case can also be a straight line; see the illustrative embodiment depicted in FIGS. 17 to 19.

All the characteristics depicted in the description, the following claims and the drawings can be fundamental to the invention both individually and in any combination with one another.

LIST OF REFERENCE DESIGNATIONS

1 pivoting mechanism
2 basic support
3 tapered holder
4 seat support
5 backrest support
6 front end of the basic support
7 front end of the seat support
8 pivotable hinge
9 main pivot axis
10 (free)
11 longitudinal direction of the chair
12 rear end of the seat support
13 bearing point
14 front end of the backrest support
15 spring mechanism
16 leg spring
17 upper spring leg
18 lower spring leg
19 underside
20 (free)
21 (free)
22 bearing pin
23 direction of pivoting
24 bearing prism
25 spring axis
26 bearing surface
27 rolling contact bearing
28 underside of the spring leg
29 first application point
30 functional surface
31 second application point
32 bearing block
33 front end of the bearing block
34 adjustment wedge
35 recess
36 rotating point
37 rear end of the bearing block
38 pivot axis
39 direction of pivoting
40 (free)
41 free end
42 threaded rod
43 hand wheel
44 wedge nut
45 dovetail guide
46 contact surface
47 (free)
48 compression spring
49 lever arm
50 guide flanks
51 hexagonal shaft
52 retaining leg
53 retaining leg
54 spring seat
55 moving end of the spring
56 fixed end of the spring
57 spring seat
58 guide rod
59 pivotable hinge of the retaining leg
60 pivot point for the hexagonal shaft
61 guide arrangement
62 guide arrangement
63 tension spring
64 rear end of the spring
65 transverse pin
66 front end of the spring
67 guide arrangement
68 rear end of the basic support
69 guide arrangement
70 structural element
71 structural element
72 coupling element
73 pivot point

The invention claimed is:

1. An office chair mechanism for an office chair, comprising:

a displaceable actuating element configured to change a position thereof during a movement of the office chair mechanism, wherein a change in position of said actuating element changes a movement characteristic of the office chair mechanism;

a functional element operatively connected to said actuating element, said functional element changing a position in the event of a change in the position of said actuating element during a movement of the office chair mechanism; and wherein at least one property of the change in position of said actuating element changes in the event of the change in the position of said functional element;

an adjustment device configured for adjusting the at least one property of the change in position of said functional element, said adjustment device including a supporting or guiding track for said functional element and an adjustment element for changing at least one property of said supporting or guiding track, the at least one property of said supporting or guiding track being an inclination thereof.

2. The mechanism according to claim 1, which comprises:

a spring mechanism including at least one spring element, said spring mechanism being operatively connected to a backrest support of the office chair and determining a resistance to pivoting of the backrest support on pivoting from an initial position into a pivoted position;

said spring mechanism including said actuating element, the position whereof changes in the event of the pivoting of the backrest support, and the change in the position thereof changing a tension of the at least one spring element; and wherein said actuating element is operationally connected to said functional element, and the position of said functional element changes in the event of a change in the position of said actuating element during pivoting of the backrest support.

3. The mechanism according to claim 2, wherein said spring mechanism is connected to the backrest support via a coupling element formed by a seat support of the office chair.

4. The mechanism according to claim 2, wherein said spring mechanism is directly connected to the backrest support.

5. The mechanism according to claim 2, wherein said at least one spring element is a helical spring formed as a leg spring, and said actuating element is an integral component part of said leg spring.

6. The mechanism according to claim 5, wherein said actuating element is a spring leg of said leg spring.

7. The mechanism according to claim 2, wherein said at least one spring element is a helical compression spring, and said actuating element is a lever arm disposed to act on said helical spring via a coupling device.

8. The mechanism according to claim 2, wherein said at least one spring element is a helical tension spring, and said actuating element is an integral component part of said helical tension spring.

9. The mechanism according to claim 2, wherein said actuating element forms a hook provided on an end of said spring or an eye thereof.

10. The mechanism according to claim 2, wherein at least one of said functional element and said adjustment device is configured such that a setting of the at least one characteristic of the change in position of the functional element takes place without having to work against a spring force of said at least one spring element.

11. The mechanism according to claim 1, wherein a property of the change in position of said actuating element or said functional element is the nature of the change in position.

12. The mechanism according to claim 1, wherein a property of the change in position of said actuating element or said functional element is a possible extent of the change in position.

13. The mechanism according to claim 1, wherein said functional element is a rolling or sliding element position-adjustably mounted and acted upon directly by said actuating element.

14. The mechanism according to claim 13, wherein said rolling or sliding element is a cylindrical pin.

15. The mechanism according to claim 14, wherein said functional element is formed with at least one rolling contact bearing.

16. The mechanism according to claim 13, wherein said functional element includes at least one bearing.

17. The mechanism according to claim 1, wherein said functional element, in the event of pivoting of the backrest support, is enabled to be displaced as far as an end position, the end position depending on the changeable property of said supporting or guiding track.

18. A device for an office chair mechanism of an office chair, comprising:

a position-adjustable functional element in the form of a rolling element or a sliding element;

at least one bearing for rotationally bearing said functional element;

at least one bearing surface of a bearing block forming a supporting or guiding track for said bearing;

an adjustment element for adjusting an inclination of said at least one bearing surface;

said functional element being connectable to a displaceable actuating element, wherein a position of the actuating element changes during a movement of the office chair mechanism and the change in position thereof changes the movement characteristic of the office chair mechanism; and a position of said functional element changing in an event of a change in position of the actuating element during a movement of the office chair mechanism, wherein at least one property of the change in position of the actuating element changes when the position of the functional element changes.

19. A method of changing a movement characteristic of a mechanism of an office chair, which comprises:

providing the mechanism with a displaceable actuating element;

changing a position of the actuating element during a movement of the office chair mechanism, with the change in position of the actuating element changing the movement characteristic of the office chair mechanism;

providing an operative connection between the actuating element and a functional element, causing a change in position of the functional element in the event of a change in the position of the actuating element during a movement of the office chair mechanism, wherein at least one property of the change in position of the actuating element changes in the event of a change in the position of the functional element; and adjusting the at least one property of the change in position of the functional element via an adjustment device, the adjustment device including a supporting or guiding track for the functional element and an adjustment element for changing at least one property of the supporting or guiding track, the at least one property of the supporting or guiding track being an inclination thereof.

20. The method according to claim 19, wherein the mechanism serves to change a tension of at least one spring element of a spring mechanism that is operatively connected to a backrest support and determines a resistance of the backrest support against pivoting in an event of a pivoting thereof from an initial position into a pivoted position, the spring mechanism including the actuating element, the position thereof changing in the event of the pivoting of the backrest support, whereby the change in the position thereof changes a tension of the at least one spring element, the position of the functional element that is operatively connected to the actuating element changing in the event of a change in the position of the actuating element during pivoting of the backrest support.

* * * * *